US008376425B2

(12) United States Patent
Paskonis

(10) Patent No.: US 8,376,425 B2
(45) Date of Patent: Feb. 19, 2013

(54) AUTOMOTIVE DOOR STRIKER

(75) Inventor: Almantas K. Paskonis, Concord Township, OH (US)

(73) Assignee: MSD Stamping LLC, Livonia, MI (US)

( * ) Notice: Subject to any disclaimer, the term of this patent is extended or adjusted under 35 U.S.C. 154(b) by 753 days.

(21) Appl. No.: 12/462,290

(22) Filed: Jul. 31, 2009

(65) Prior Publication Data

US 2011/0025079 A1 Feb. 3, 2011

(51) Int. Cl.
*E05B 15/02* (2006.01)

(52) U.S. Cl. ..... 292/341.15; 292/341.12

(58) Field of Classification Search ..... 292/341.15, 292/341.12, 1, 341.18, 341.19
See application file for complete search history.

(56) References Cited

U.S. PATENT DOCUMENTS 3,240,524 A 3/1966 Priestman
3,296,694 A 1/1967 De Mastry et al.
3,331,624 A 7/1967 Pugh
3,350,128 A * 10/1967 Martens ..... 292/341.12
3,536,349 A 10/1970 Gardner et al.
3,572,797 A 3/1971 Shay
3,591,225 A 7/1971 Hagemeyer
3,655,228 A 4/1972 Coopersmith et al.
3,680,902 A 8/1972 Slattery
3,722,937 A 3/1973 Stoeckl
3,848,911 A 11/1974 Watermann et al.
4,073,524 A 2/1978 Gianessi
4,087,121 A 5/1978 Davis
4,130,308 A 12/1978 Jeavons
4,174,128 A 11/1979 Styck
4,288,117 A 9/1981 Nardi
4,357,039 A 11/1982 Tolle
4,650,231 A 3/1987 Shimura et al.
4,783,103 A 11/1988 Schlegel
4,856,829 A 8/1989 Nakamura et al.
4,861,099 A 8/1989 Sasamura et al.
4,883,298 A * 11/1989 Kleefeldt ..... 292/341.12
4,896,906 A 1/1990 Weinerman et al.
4,896,908 A 1/1990 Kleefeldt
4,932,100 A 6/1990 Flowers et al.
5,039,144 A 8/1991 Tolle
5,064,229 A 11/1991 Hamada et al.
5,069,491 A 12/1991 Weinerman et al.
5,125,698 A 6/1992 Thau
5,423,582 A 6/1995 Kleefeldt
5,501,495 A 3/1996 Claucherty
5,529,356 A 6/1996 Cetnar
5,606,771 A 3/1997 Young
5,707,095 A 1/1998 Pribak et al.
5,727,825 A 3/1998 Spurr
5,785,365 A 7/1998 Lorey
5,802,671 A 9/1998 Ikuma
5,890,755 A 4/1999 Speelman et al.
5,937,585 A 8/1999 Tidbury et al.
6,039,364 A 3/2000 Rieger et al.
6,073,980 A 6/2000 Arabia, Jr. et al.
6,095,576 A 8/2000 Burton
6,106,037 A 8/2000 Burton
6,108,894 A 8/2000 Mizuki et al.
6,149,213 A 11/2000 Sokurenko et al.

(Continued)

*Primary Examiner* — Carlos Lugo
*Assistant Examiner* — Mark Williams
(74) *Attorney, Agent, or Firm* — Greenberg Traurig, LLP

(57) ABSTRACT

Automotive door striker having a center-mounted hex nut integrally formed as part of the striker pin. A rotatable elastomeric sleeve is provided for noise reduction. A baseplate connects the striker pin to a mounting flange for a shock absorber.

12 Claims, 13 Drawing Sheets

U.S. PATENT DOCUMENTS

| | | | | |
|---|---|---|---|---|
| 6,267,421 | B1 | 7/2001 | Burton | |
| 6,273,480 | B1 | 8/2001 | Burton | |
| 6,364,380 | B2 | 4/2002 | Franz | |
| 6,672,634 | B2 | 1/2004 | Burton | |
| 7,029,043 | B2 | 4/2006 | Fisher | |
| 7,140,652 | B2 | 11/2006 | Johnson et al. | |
| 7,159,289 | B1 | 1/2007 | Moore | |
| 7,322,127 | B2 | 1/2008 | Hwang | |
| 7,617,584 | B1 | 11/2009 | Moore | |
| 2002/0047280 | A1 | 4/2002 | Burton | |
| 2004/0145193 | A1 | 7/2004 | Walcome | |
| 2005/0218669 | A1 | 10/2005 | Johnson et al. | |
| 2006/0123619 | A1 | 6/2006 | Nilsson | |
| 2007/0001468 | A1 | 1/2007 | Burton | |
| 2007/0114802 | A1* | 5/2007 | Johnson et al. | 292/340 |
| 2007/0241570 | A1 | 10/2007 | Paskonis | |
| 2008/0100070 | A1 | 5/2008 | Fannon et al. | |
| 2009/0212579 | A1 | 8/2009 | Hemingway et al. | |

* cited by examiner

FIG. 20
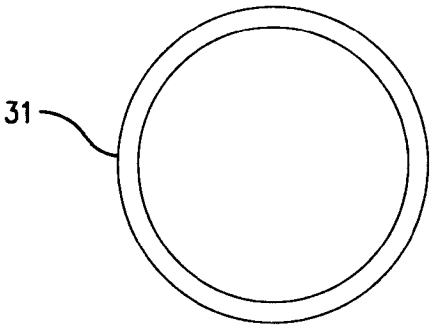
FIG. 21
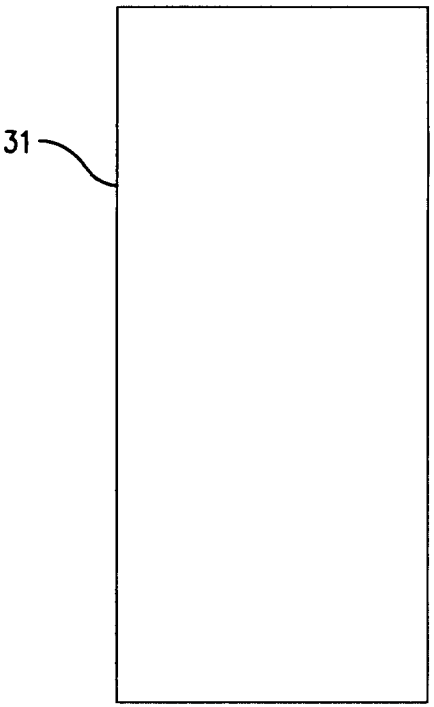
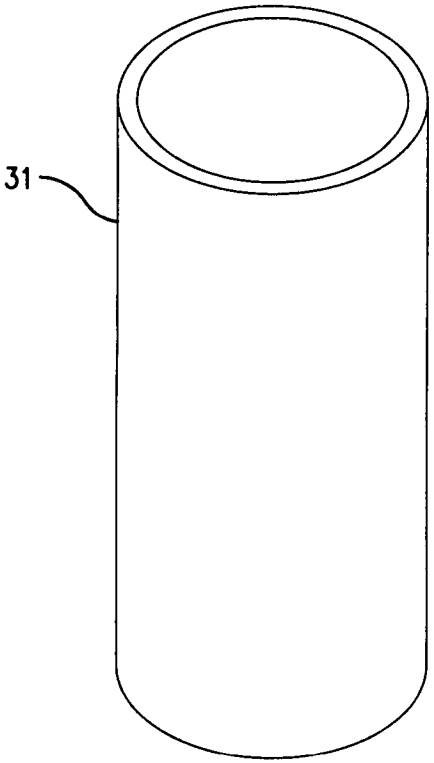
FIG. 19

AUTOMOTIVE DOOR STRIKER

BACKGROUND OF THE INVENTION

1. The Technical Field

The present invention is directed to automotive door strikers, to be mounted in the frames or door sills of vehicles, for engaging latching structures mounted in vehicle doors.

2. The Prior Art

Door strikers, for use in automotive applications, are known, and may be of the cantilevered pin or loop (also known variously as "bent wire", "shielded", or "guarded") form. The loop style is typically more complicated and therefore more costly to construct, as well as often being heavier, than cantilevered pin style door strikers.

It would be desirable to provide a door striker which may be used in automotive applications, which is robust, easily installed, and configured to reduce noise and vibration during use.

These and other desirable characteristics of the present invention will become apparent in view of the present specification, including claims, and drawings.

SUMMARY OF THE INVENTION

The invention is directed in part to an automotive striker pin having a hex structure positioned midpoint along the pin, providing a drive point, in turn, facilitating the use of a recess cup washer, providing for a rubber bumper and a retainer for a trim panel, thus facilitating noise reduction and vibration.

Midpoint drive capability allows for installation of a polymer (or other material) sleeve for noise reduction and a cushioned fit of the door latch closing around the sleeve surface.

The striker sleeve is retained by a striker cap installed and retained by upsetting of the striker pin end protruding from the cap.

The combination of a polymer sleeve and a rubber bumper provides for reduction in latch to striker movement, thus also reducing vibration, squeaks and rattles of door to body during vehicle operation.

The polymer sleeve is free to rotate on the striker pin so as to is reduce noise during both closing and opening operations of the latch to striker.

The striker bumper is attached to the striker pin by a bracket thus enabling constant force of compression to the latch face and opening, thus maintaining a positive load on the striker pin.

BRIEF DESCRIPTION OF THE DRAWINGS

FIG. 19 is a perspective view of the pin sleeve for the door striker according to an embodiment of the present invention.

FIG. 20 is an end view of the pin sleeve of FIG. 19.

FIG. 21 is a side elevation of the pin sleeve of FIG. 19.

DETAILED DESCRIPTION OF THE INVENTION

Figure 1:
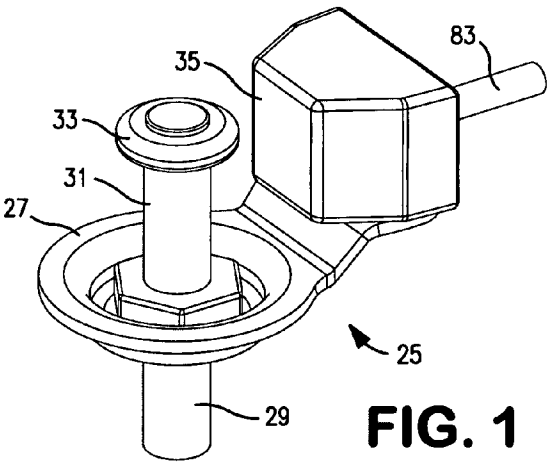
FIG. 1 is a perspective view of the door striker of the present invention according to an embodiment of the invention.
Figure 3:
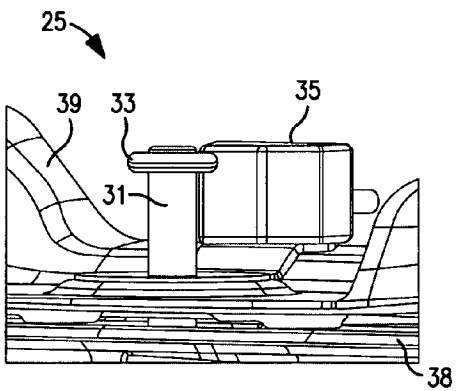
FIG. 3 is another perspective view, showing the door striker of FIG. 1.
Figure 2:
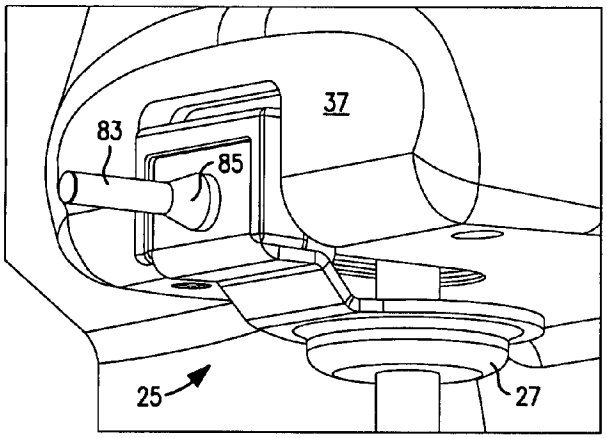
FIG. 2 is another perspective view, showing the door striker of FIG. 1 in engagement with a door.
Figure 4:
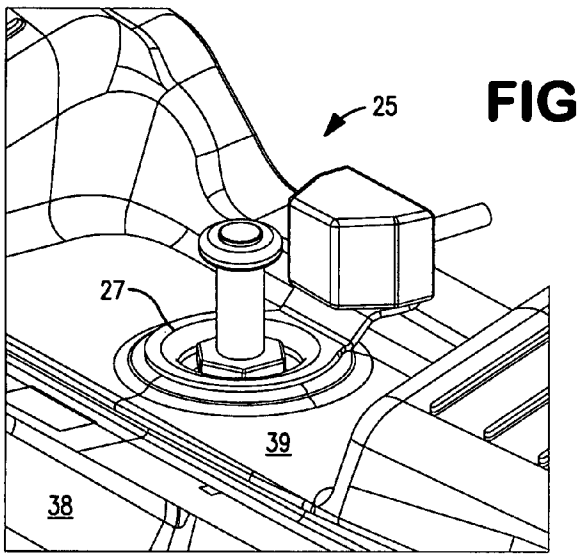
FIG. 4 is another perspective view, showing the door striker of FIG. 1.

While this invention is susceptible of embodiment in many different forms, there are shown in the drawings and will be described in detail several specific embodiments, with the understanding that the present disclosure is to be considered an exemplification of the principles of the invention and is not intended to limit the invention to the embodiments illustrated.

The following description and drawings are illustrative and are not to be construed as limiting. Numerous specific details are described to provide a thorough understanding of the disclosure. However, in certain instances, well-known or conventional details are not described in order to avoid obscuring the description. References to one, or an, embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments, but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks.

The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification, including examples of any terms discussed herein, is illustrative only, and in no way limits the scope and meaning of the disclosure or of any exemplified term. Likewise, the disclosure is not limited to various embodiments given in this specification.

Unless otherwise defined, all technical and scientific terms used herein have the same meaning as commonly understood by one of ordinary skill in the art to which this disclosure pertains. In the case of conflict, the present document, including definitions will control.

Figure 6:
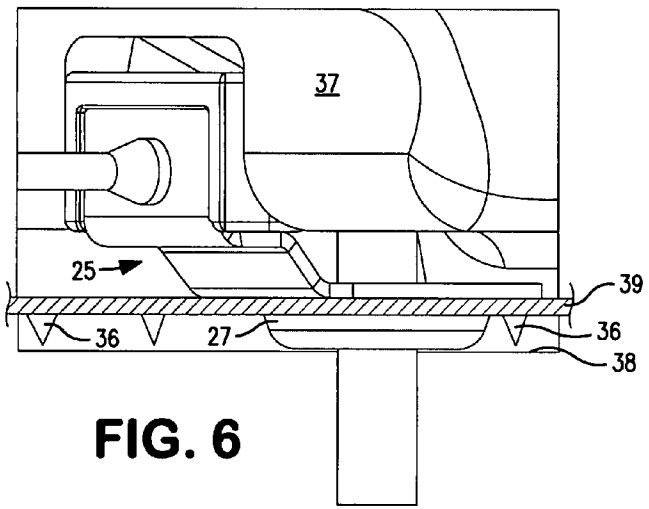
FIG. 6 is another perspective view, showing the door striker of FIG. 1.
Figure 11:
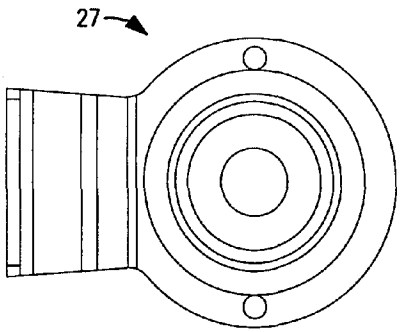
FIG. 11 is a bottom view of the striker baseplate of FIG. 9.
Figure 14:
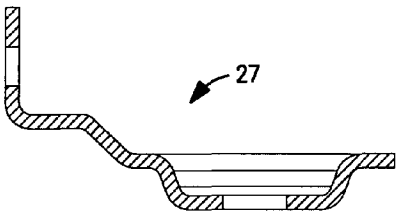
FIG. 14 is a side sectional view of the striker baseplate of FIG. 9, taken along line 14-14 of FIG. 13.
Figure 13A:
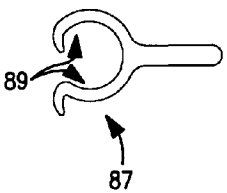
FIG. 13A is a perspective view of a retention tool, according to an embodiment of the invention, for use in installing a striker assembly according to the present invention.
Figure 13:
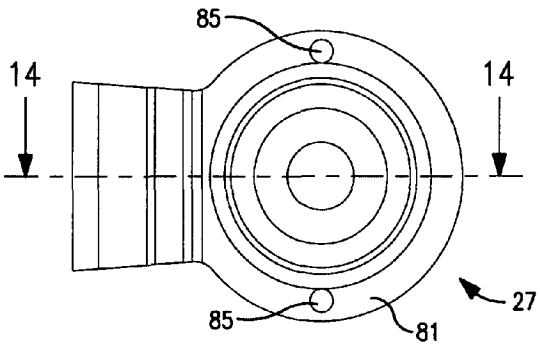
FIG. 13 is a top view of the striker baseplate of FIG. 9.
Figure 12:
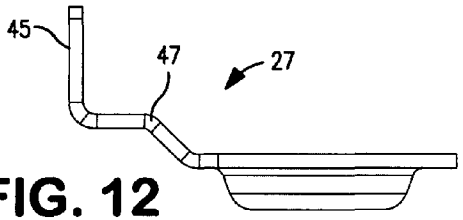
FIG. 12 is a side elevation of the striker baseplate of FIG. 9.
Figure 15:
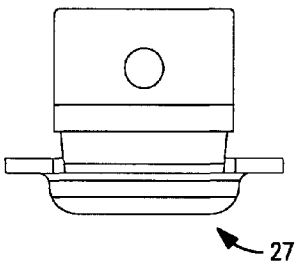
FIG. 15 is an end view of the striker baseplate of FIG. 9.
Figure 9:
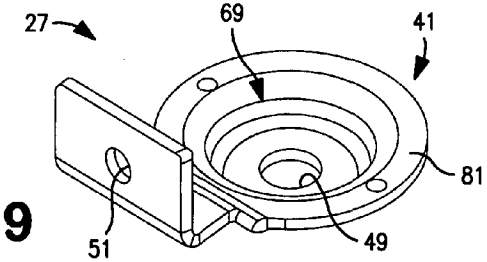
FIG. 9 is a top perspective view of a striker baseplate, according to an embodiment of the invention.
Figure 10:
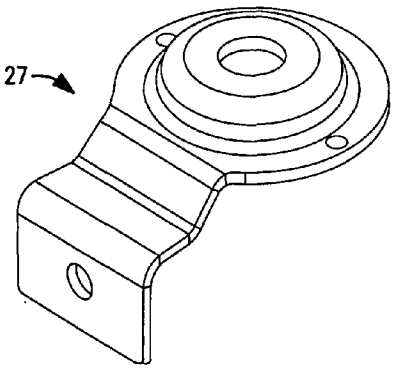
FIG. 10 is a bottom perspective view of the striker baseplate of FIG. 9.

Door striker assembly 25, according to an embodiment of the invention, is shown in FIGS. 1-6 and includes baseplate 27, striker pin 29, pin sleeve 31, pin cap 33 and shock absorber 35. Door striker assembly 25 is mounted in a door jamb or frame 38 of, e.g., an automobile (not shown), with the portion of striker pin 29 bearing pin sleeve 31 and pin cap 33 exposed and "facing" outwardly, so as to engage the latch portion of a vehicle door 37. In a typical installation, body trim panel 39 will be positioned between door frame 38 and baseplate 27, and the flange of baseplate 27 will bear against trim panel 39, so as to place a slight compression on trim panel 39, to reduce vibration and noise. FIG. 6 illustrates this concept from a side view, in that typically, the outer surface of trim panel 39 will stand off from the outer surface of door jamb 38, by virtue of various ribs 36. As pin 29 is torqued down into the threaded aperture in door jamb 38, the flange of baseplate 27 compresses trim panel 39, until the lower surface of the bowl-like depression 69 bottoms out against the outer surface of door jamb 38.

Referring to FIGS. 9-15, striker baseplate 27 includes pin attachment region 41, pin aperture 43, shock absorber attachment flange 45, web 47, fastener aperture(s) 49 and shock absorber fastener aperture 51.

Baseplate 27 may be fabricated from steel alloy, or any other suitable material having similar characteristics. Bowl-like depression or concavity 69 is configured to fit into a corresponding circular aperture (not shown) in trim panel 39, with radially extending flange 81 provided to bear against trim panel 39.

Figure 17:
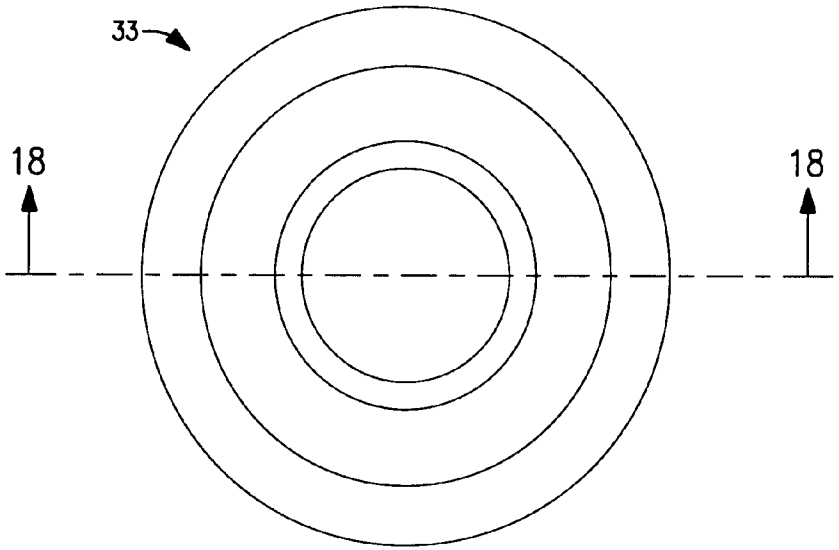
FIG. 17 is a top view of the pin cap of FIG. 16.
Figure 18:
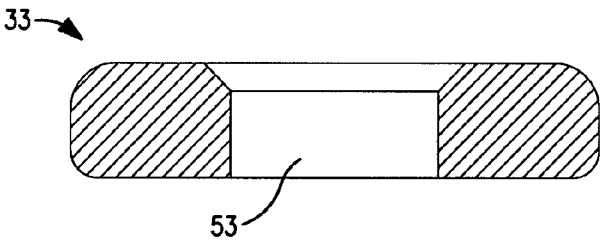
FIG. 18 is a side sectional view of the pin cap of FIG. 16, taken along line 18-18 of FIG. 17.
Figure 16:
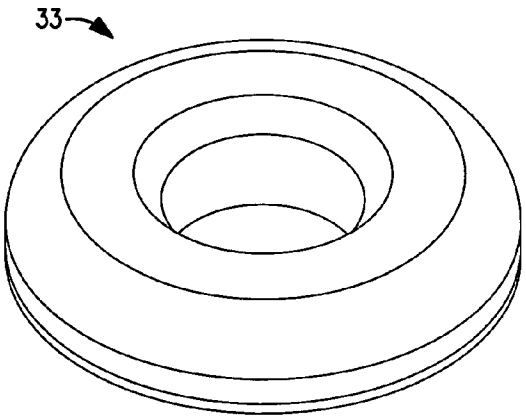
FIG. 16 is a perspective view of a pin cap for the door striker according to an embodiment of the present invention.

Referring to FIGS. 16-18, pin cap 33 may be fabricated from steel or polymer, or any other suitable material having similar characteristics. Pin cap 33, in an embodiment of the invention, includes bore 33, at one end of which, corresponding to an end of striker pin 29, includes chamfer 55.

Referring to FIGS. 19-21, pin sleeve 31 may be fabricated from polymer, Teflon, or any other suitable material having similar shock absorbing, vibration deadening and noise reducing characteristics. Typically, pin sleeve 31 may have a wall thickness on the order of 1.4 mm±0.25 mm.

Figures 22, 23, 24:
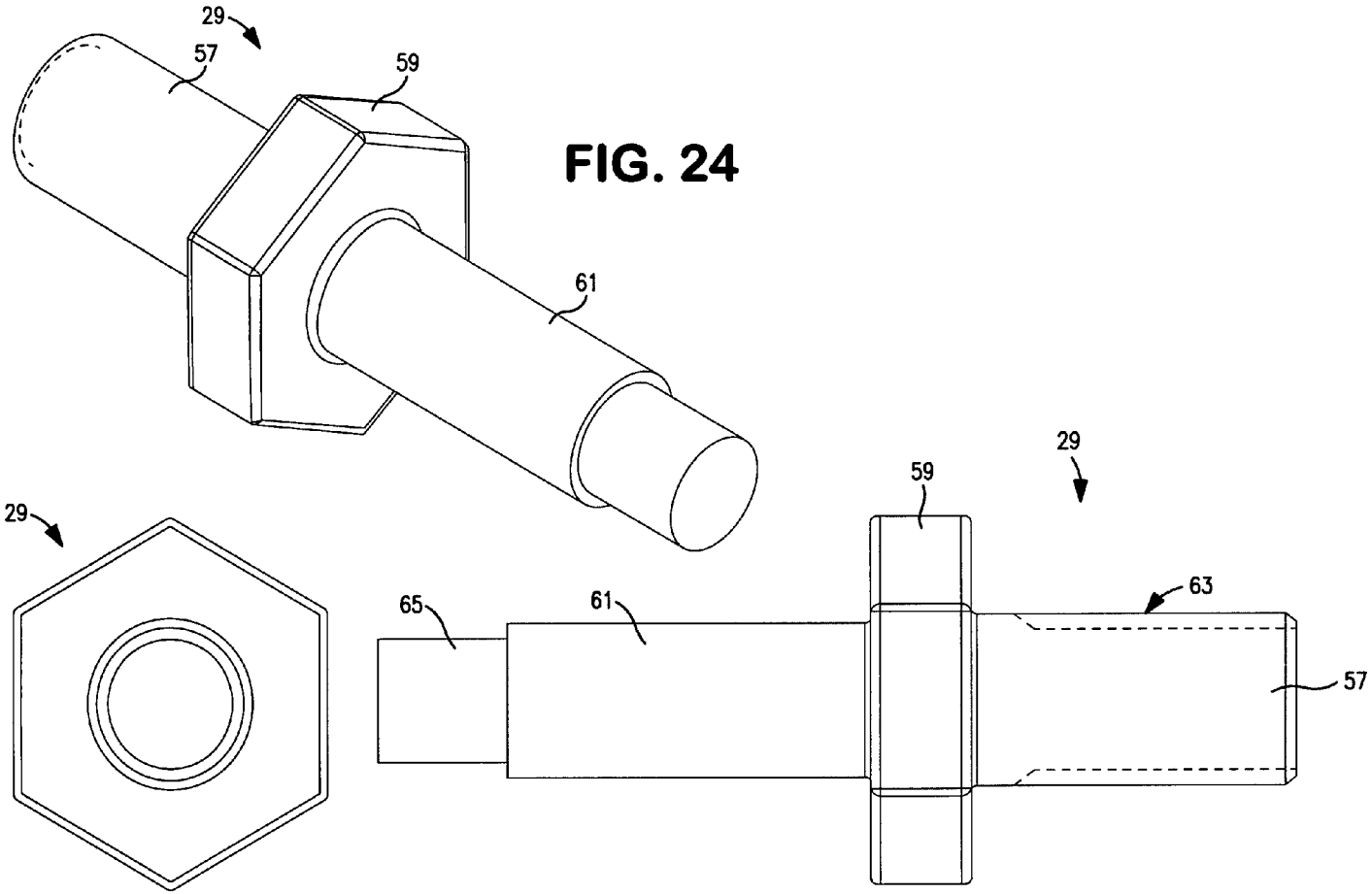
FIG. 22 is a side elevation of a striker pin of the door striker according to an embodiment of the present invention.
FIG. 23 is an end view of the striker pin of FIG. 22.
FIG. 24 is a perspective view of the striker pin of FIG. 22.

Referring to FIGS. 22-24, striker pin 29 may be fabricated from steel alloy, or similar material. Striker Pin 29 includes mounting shaft portion 57, drive hex 59, and latch engaging shaft 61, which are all monolithically formed as a single piece, e.g., by forging, casting, machining, etc. Mounting shaft portion 57 will be threaded, e.g., at 63, for engagement with a suitably threaded portion of a vehicle door jamb or frame (not shown). Drive hex 59 is provided to give a ready point of engagement for a wrench or other tool, to drive striker pin 29 into the aforementioned threaded portion of a vehicle door jamb or frame. Latch engaging shaft 61 includes sleeve retaining portion 65, which has a length which will be greater than the length of pin sleeve 31.

Assembly of the striker is accomplished by sliding sleeve 61 onto pin 29, and then positioning pin cap 33 onto cap retaining portion 65, and swaging the end of cap retaining portion 65 of striker pin 29. Next, bumper 35 is placed on flange 45, by pulling or pushing barb-shaped tab 83 through fastener aperture 51, until the flat side of barb portion 85 bears against flange 45. Typically, the thickness of flange 45 and the length of tab 83, between barb 85 and bumper 35 will be such that there will be tension in tab 83 sufficient to keep bumper 35 tightly in place on flange 45. Pin attachment region 41 of baseplate 27 is then aligned with the aperture 43 in door jamb 38. Threaded portion 63 of striker pin 29 is then inserted and threaded into aperture 43, using hex 63 to tighten striker pin 29.

Figure 25:
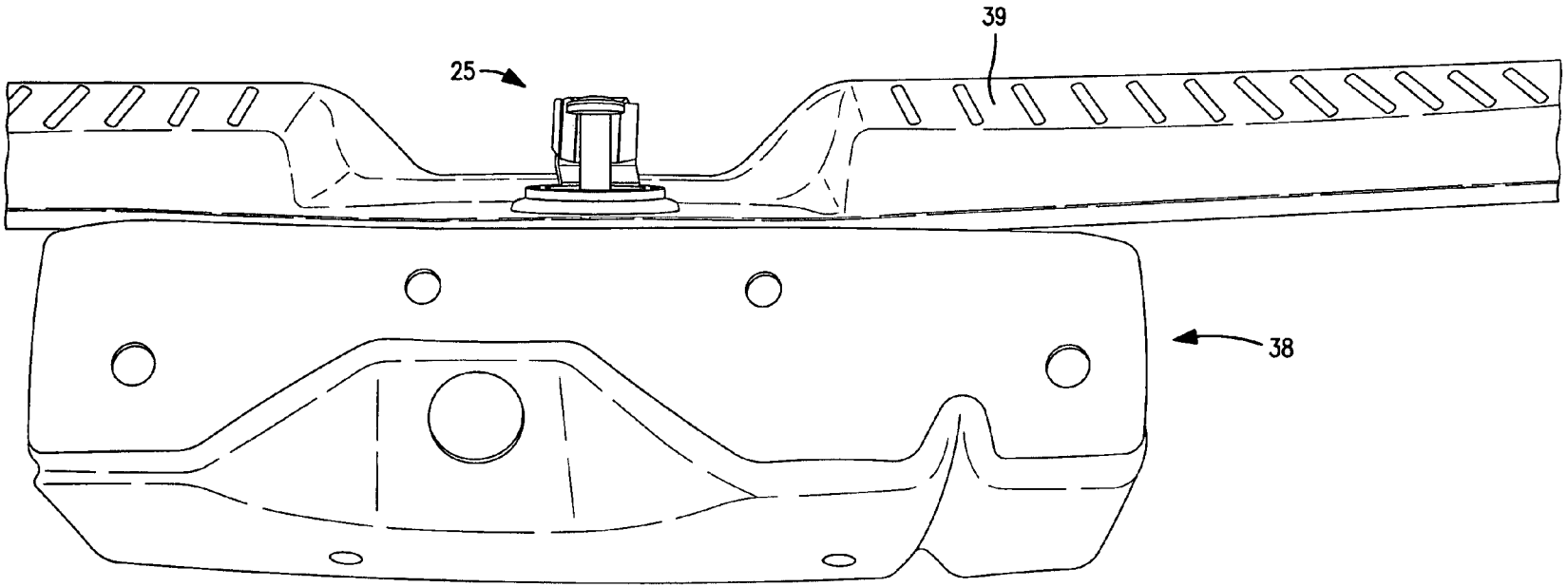
FIGS. 25-31 illustrate various additional views of the automotive door striker of the embodiment of FIGS. 1-6, in various stages of assembly and/or installation.
Figure 26:
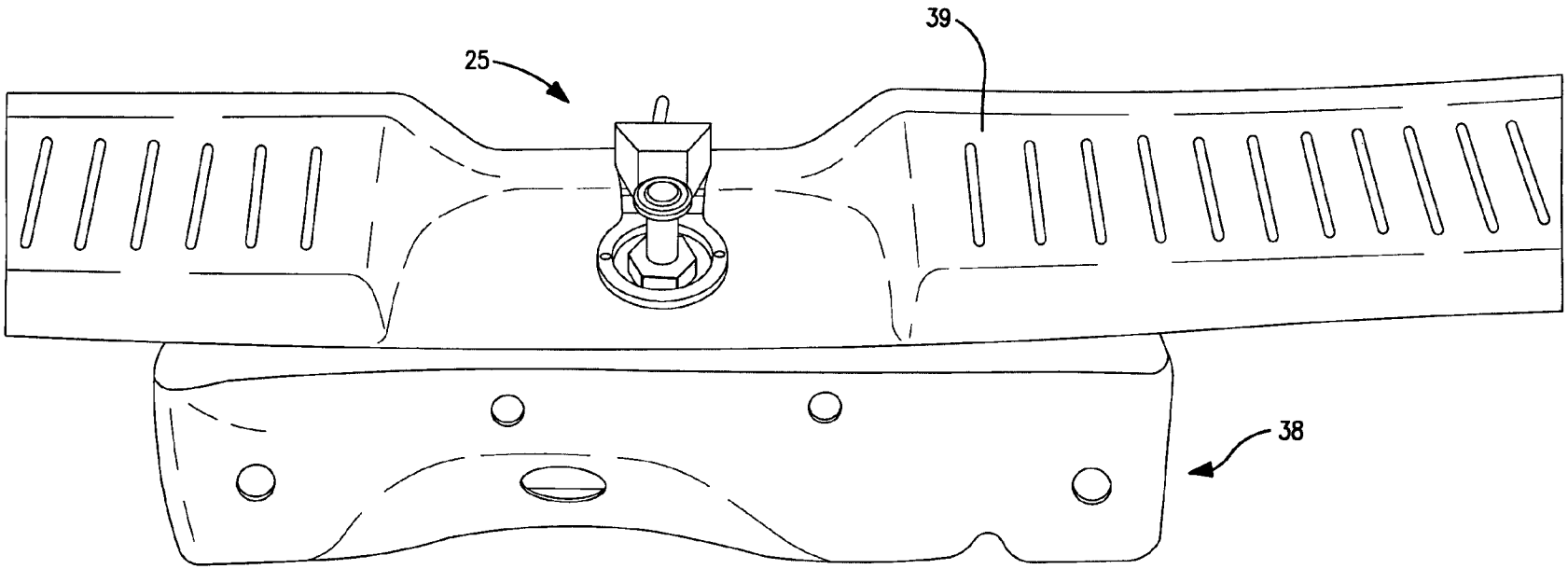
Figure 27:
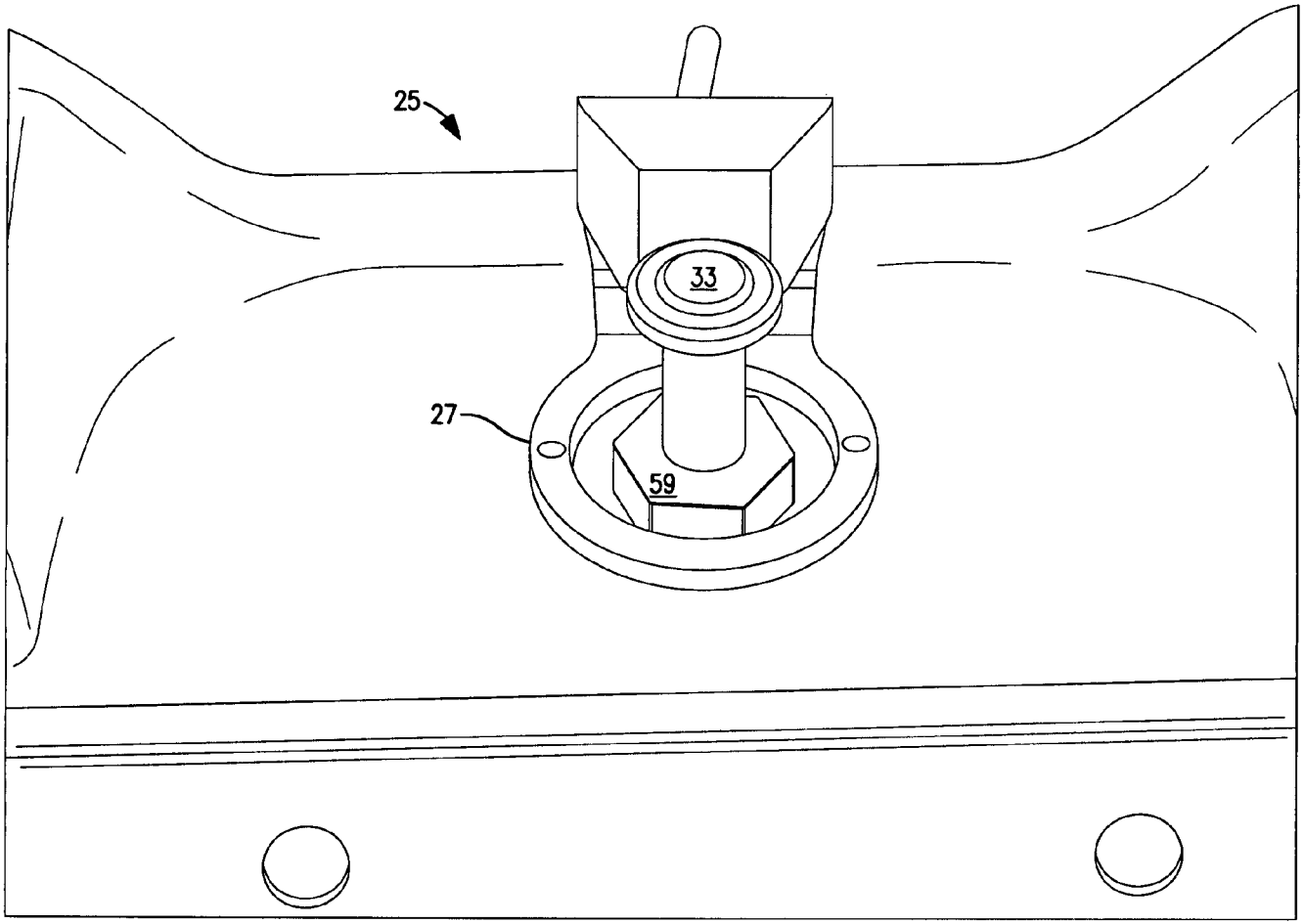
Figure 28:
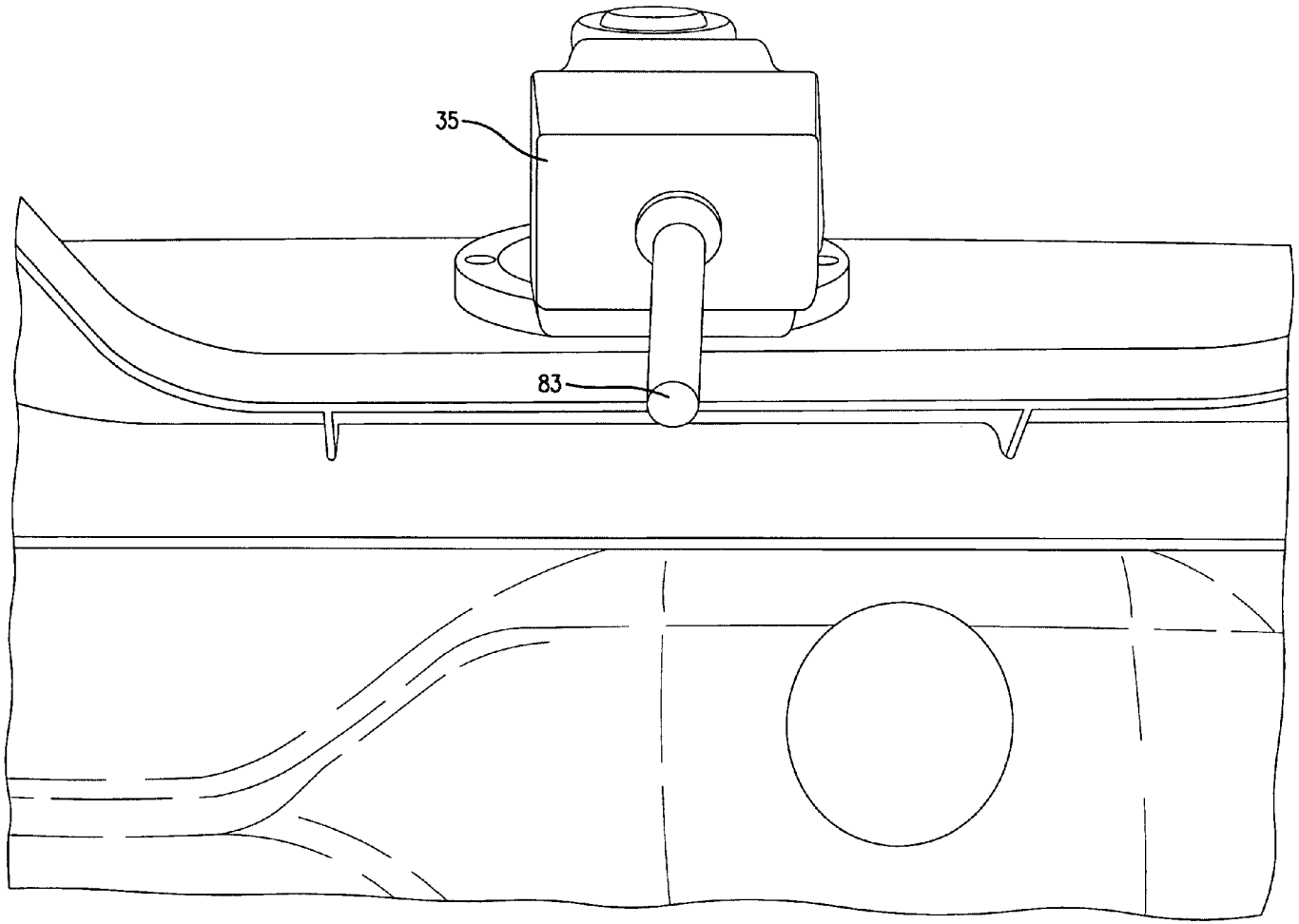
Figure 29:
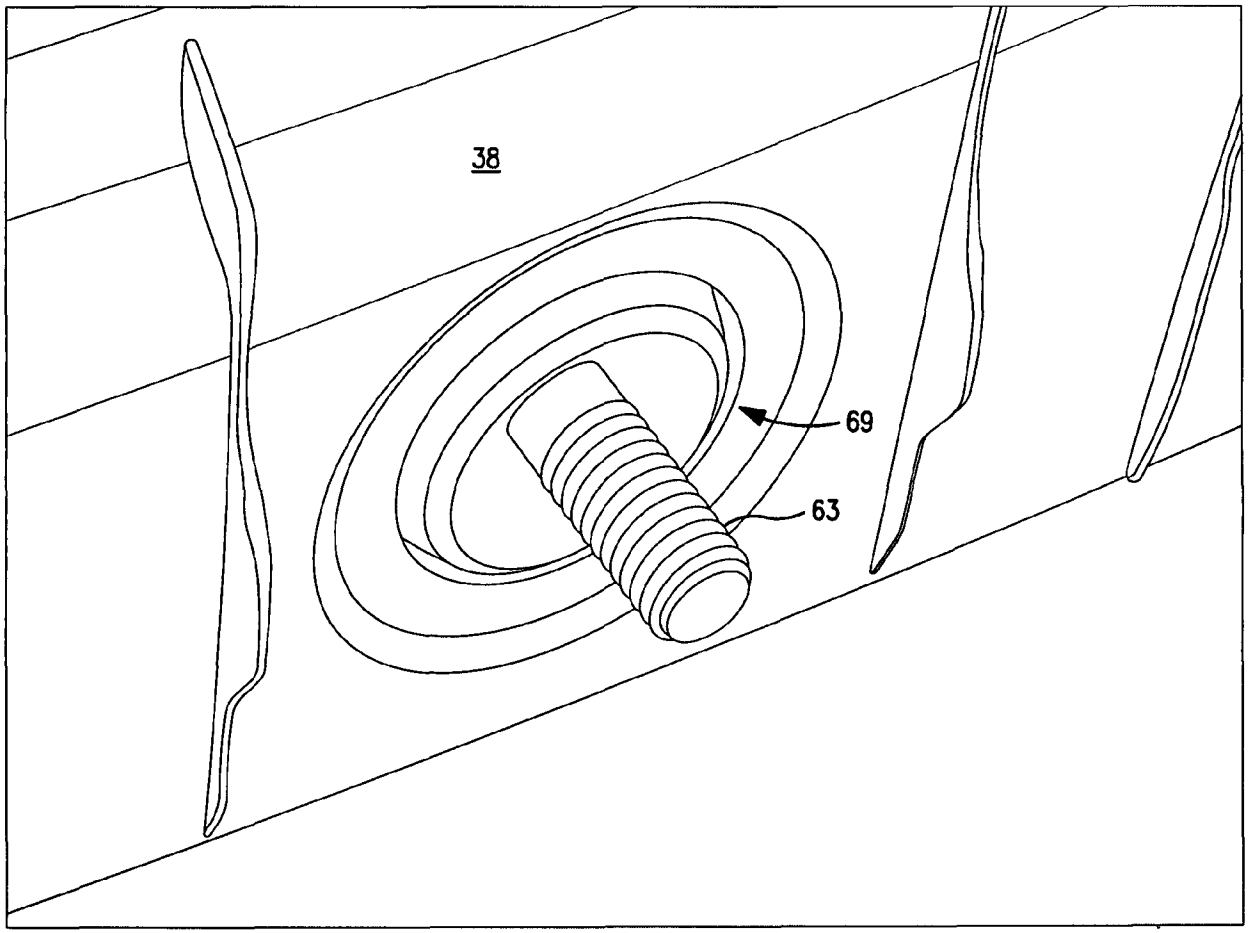
Figure 30:
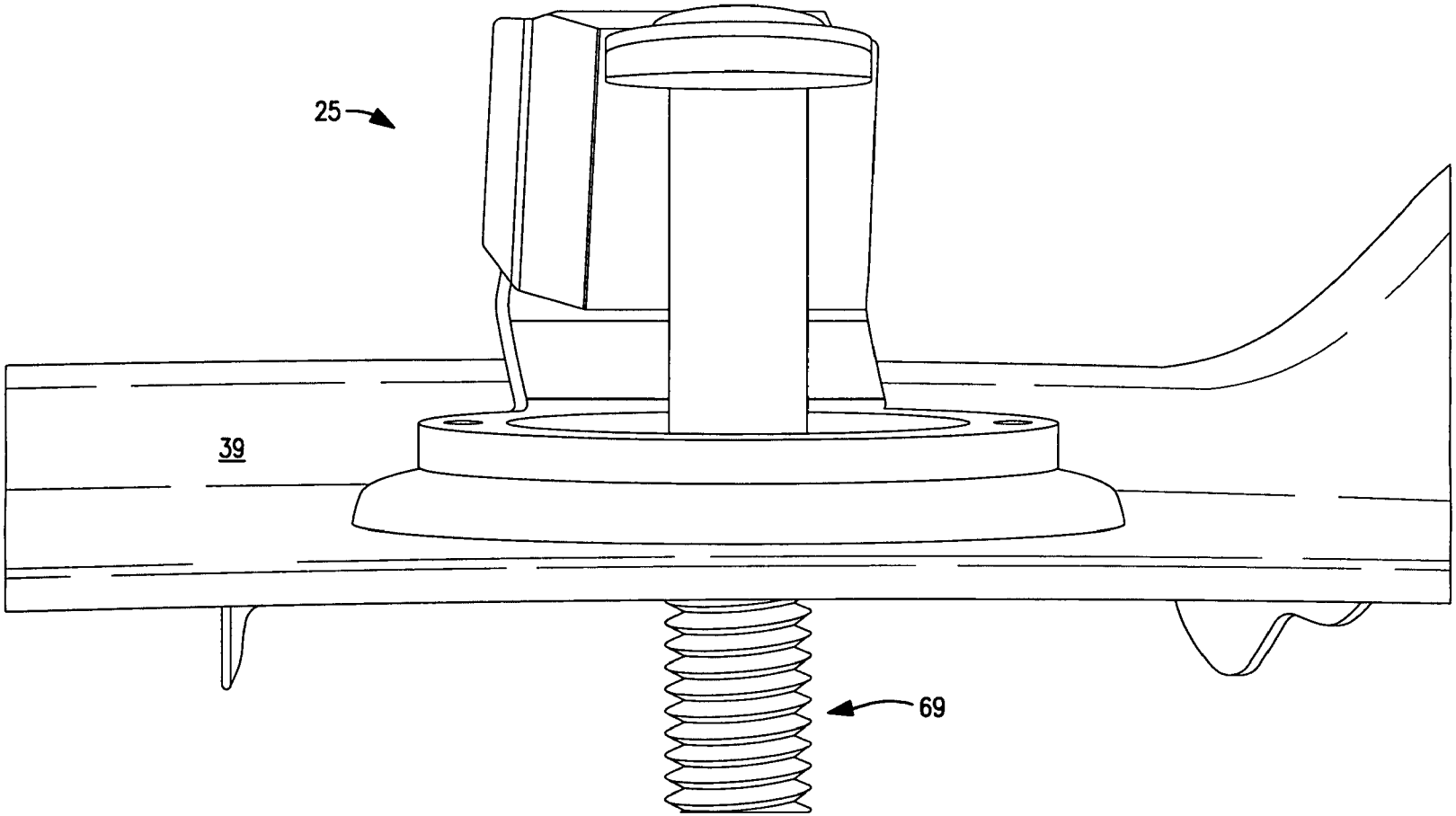
Figure 31:
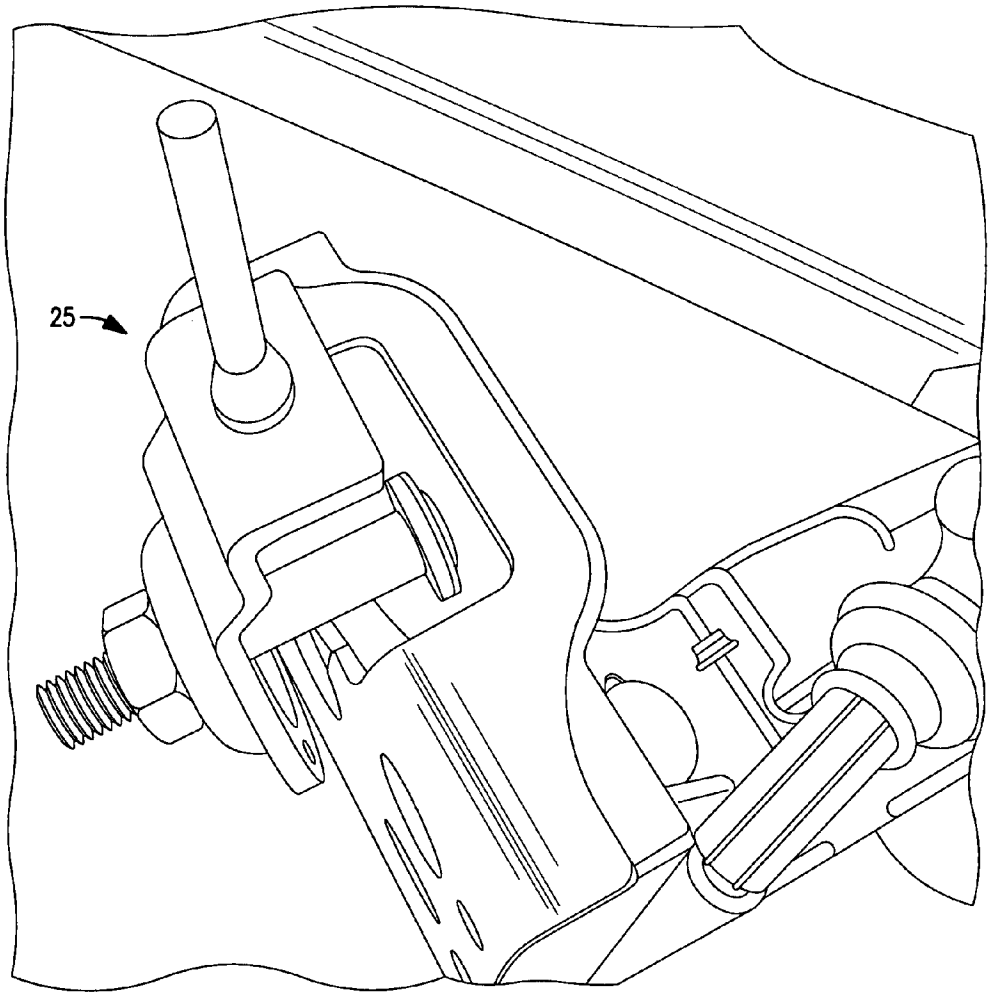

FIGS. 25-32 illustrate various additional views of the automotive door striker of the embodiment of FIGS. 1-6, in various stages of assembly and/or installation. Specifically, FIG. 25 shows door striker assembly 25 affixed to door jamb 38, with trim plate 39 captured therebetween. FIG. 26 is a similar view from a different angle showing the drive hex 59 received within the bowl-shaped portion 69 of the flange 41. FIG. 27 is an enlarged view of FIG. 26. FIG. 28 is a reverse view, showing the rear side of bumper 35 and tab 83. FIG. 29 is a view of the bottom of bowl-shaped portion 69 as seen from "inside" the trim panel 38. FIG. 30 illustrates how threaded portion 63 projects through and beyond trim panel 38. FIG. 31 shows how striker assembly 25 (shown not affixed to a door jamb) may confront a typical door latch assembly.

Figure 7:
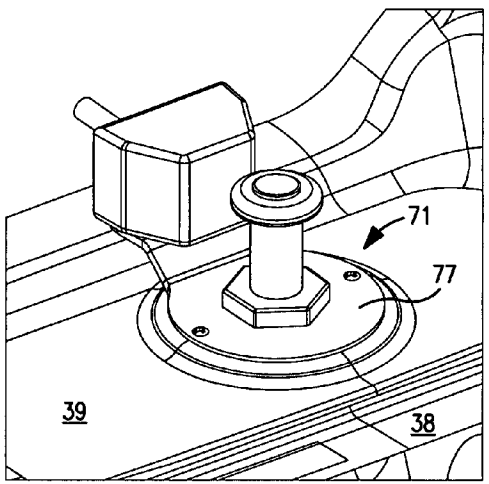
FIG. 7 is a perspective view of a door striker according to another embodiment of the invention.
Figure 8:
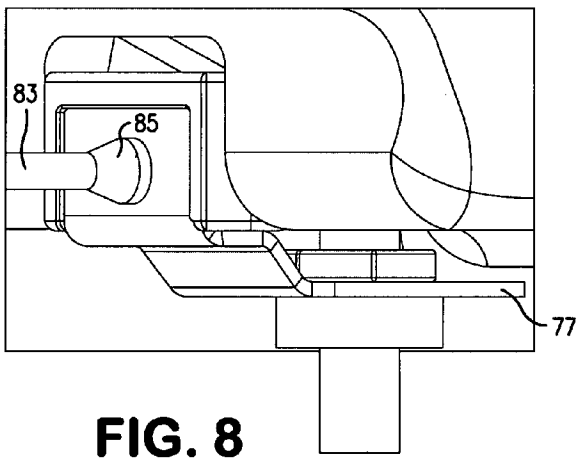
FIG. 8 is a side view of the door striker of FIG. 7, shown in engagement with a door.
Figure 5:
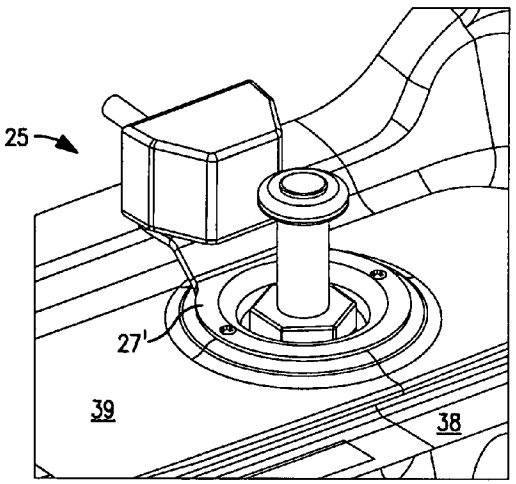
FIG. 5 is another perspective view, showing the door striker of FIG. 1.

An alternative embodiment of the door striker assembly of the present invention is shown in FIGS. 7 and 8. In door striker assembly 71, baseplate 77 is slightly different from baseplate 27 of the embodiment of FIGS. 1-6 in that instead of having a cup or bowl-like depression 69, pin attachment region 77 is a flat circular plate. This may be employed in situations where there is no corresponding larger sized opening in the trim panel. However, because the bowl-shaped portion is absent, to prevent the striker assembly from undesirably deforming the trim panel, a spacer member may have to be positioned under the trim panel, through which the threaded portion of the striker pin has to pass, before engaging the threaded portion of the door jamb. Otherwise, the attachment of striker assembly is substantially similar to that described with respect to the embodiment of FIGS. 1-6.

The orientation of bumper 35, relative to the vehicle door is important. Specifically, the face of bumper 35 needs to upright and parallel to the vehicle centerline. There may be a propensity for flange 27 to pivot, as pin 31 is tightened down. Accordingly, to prevent this undesired repositioning, flange 27 may be provided with one or more (typically two) retention apertures 85. A retention tool 87, having a forked configuration, with spaced apart prongs 89, may be used to hold flange 27 and prevent pivoting while pin 31 is tightened.

The foregoing description and drawings merely explain and illustrate the invention, and the invention is not limited thereto, except as those skilled in the art who have the present disclosure before them will be able to make modifications and variations therein without departing from the scope of the invention.

The invention claimed is:

1. An vehicle door striker for mounting on a vehicle door frame or jamb, the striker comprising:

a baseplate, having a striker pin attachment region, and a shock absorber attachment flange arranged substantially perpendicular to an upper surface of the striker pin attachment region, the striker pin attachment region and the shock absorber attachment flange being connected by a web;

a shock absorber mounted on the shock absorber attachment flange; and a striker pin mounted on the striker pin attachment region, the striker pin extending through the attachment region between an upper surface and a lower surface of the striker pin attachment region, the striker pin including a mounting shaft extending from the lower surface of the striker pin attachment region, the mounting shift configured to enable attachment of the vehicle door striker to the vehicle door frame or jamb, a latch engaging shaft extending from the upper surface of the striker pin attachment region, and a drive member formed on the striker pin and arranged between the mounting shaft and the latch engaging shaft, wherein the mounting shaft is configured for mounting on the vehicle door frame such that the mounting shaft extends into the vehicle door frame and the baseplate bears against a surface of the vehicle door frame, and wherein the latch engaging shaft extends outward from the vehicle door frame to releasable engage a latch portion of a vehicle door between the latch engaging shaft and the shock absorber when the vehicle door is closed, and wherein movement of the drive member causes the mounting shaft to be driven into the vehicle door frame for mounting the vehicle door striker on the vehicle door frame.

2. The vehicle door striker according to claim 1, further comprising:

a door latch engaging sleeve mounted on the latch engaging shaft of the striker pin.

3. The vehicle door striker according to claim 2, wherein the door latch engaging sleeve is fabricated from a resilient material.

4. The vehicle door striker according to claim 2, further comprising a pin cap fixedly mounted on an end of the latch engaging shaft to maintain the door latch engaging sleeve in position on the latch engaging shaft of the striker pin.

5. The vehicle door striker according to claim 1, wherein the mounting shaft, the latch engaging shaft and the at least one drive member are all part of a single monolithically formed structure.

6. The vehicle door striker according to claim 1, wherein the at least one drive member is in the form of a hex nut.

7. The vehicle door striker according to claim 1, wherein the striker pin attachment region is bowl-shaped, with a circumferentially-extending flange, to be received by a bowl-shaped depression in the vehicle door frame or jamb.

8. The vehicle door striker according to claim 1, wherein the striker pin attachment region is shaped like a flat disc.

9. The vehicle door striker according to claim 1, wherein the door striker is configured to be mounted on a vertically extending portion of a door frame, so that the striker pin is mounted in a cantilevered manner, extending in a substantially horizontal direction.

10. The vehicle door striker according to claim 1, further comprising at least one retention aperture disposed in the baseplate, for engaging a retention tool for prohibiting undesired rotation of the baseplate, during fastening of the baseplate to a vehicle.

11. The vehicle door striker according to claim 1, wherein the mounting shaft and the latch engaging shaft are coaxial.

12. The vehicle door striker according to claim 11, wherein the drive member is a nut coaxially aligned with the mounting shaft and the latch engaging shaft.

* * * * *